US008118184B2

(12) United States Patent
Ruse, Jr.

(10) Patent No.: US 8,118,184 B2
(45) Date of Patent: Feb. 21, 2012

(54) CONTAINER LID WITH PIVOTING GATE VALVE AND LINEAR ACTUATOR

(76) Inventor: Everett L. Ruse, Jr., Spokane, WA (US)

( * ) Notice: Subject to any disclaimer, the term of this patent is extended or adjusted under 35 U.S.C. 154(b) by 566 days.

(21) Appl. No.: 12/288,931

(22) Filed: Oct. 24, 2008

(65) Prior Publication Data

US 2010/0102059 A1 Apr. 29, 2010

(51) Int. Cl.

| | |
|---|---|
| ***B65D 51/18*** | (2006.01) |
| ***B65D 47/06*** | (2006.01) |
| ***A47G 19/22*** | (2006.01) |
| *B65D 51/00* | (2006.01) |

(52) U.S. Cl. ..... 220/254.4; 220/715; 220/212; 222/560

(58) Field of Classification Search ..... 220/254.5, 220/254.4, 254.3, 254.1, 264, 262, 373, 203.07, 220/203.4, 203.05, 203.01, 203.19, 715, 220/714, 713, 711, 705, 821, 820, 816, 838, 220/837, 836, 348, 345.4, 345.1; 215/315, 215/311, 305, 295, 200; 222/560, 516, 517, 222/544; D9/450, 449; 53/492; *B65D 51/04, B65D 51/18, 47/06*

See application file for complete search history.

(56) References Cited

U.S. PATENT DOCUMENTS

| | | | | | |
|---|---|---|---|---|---|
| 264,695 | A | * | 9/1882 | Henkel | 220/254.4 |
| 302,483 | A | * | 7/1884 | Haslage | 222/189.07 |
| D106,724 | S | * | 10/1937 | Gebauer | D9/450 |
| 2,187,927 | A | * | 1/1940 | Ayotte | 222/470 |
| 2,636,649 | A | * | 4/1953 | Corriveau | 222/516 |
| 3,964,631 | A | * | 6/1976 | Albert | 220/715 |
| 3,972,443 | A | * | 8/1976 | Albert | 220/715 |
| 4,094,433 | A | * | 6/1978 | Numbers | 220/715 |
| 4,099,642 | A | * | 7/1978 | Nergard | 220/715 |
| 4,133,446 | A | * | 1/1979 | Albert | 220/715 |
| 4,303,173 | A | * | 12/1981 | Nergard | 220/254.5 |
| 5,921,425 | A | * | 7/1999 | Markey | 220/254.4 |
| 2002/0092581 | A1 | * | 7/2002 | Hagano et al. | 141/348 |
| 2002/0092851 | A1 | * | 7/2002 | Belcastro | 220/254.4 |

* cited by examiner

*Primary Examiner* — Mickey Yu
*Assistant Examiner* — Robert J Hicks
(74) *Attorney, Agent, or Firm* — William A. Jeckle

(57) ABSTRACT

A lid for controlled drinking from a drinking container includes an aperture adjacent a periphery, and a closure device formed as a single continuous piece of material. The closure device has an actuator portion, a web portion and a valve portion. The actuator portion has a distal portion extending outward of the periphery, and a proximal portion attached to a first end of the web portion. A second end of the web is attached to the valve portion. The valve portion can rotate about a pivot point and move from a closed position over the aperture when the actuator portion is in a first position, towards an open position away from the aperture when the actuator portion is moved towards a second position, during which the web winds around a suitably shaped region partially surrounding the pivot point.

20 Claims, 4 Drawing Sheets

CONTAINER LID WITH PIVOTING GATE VALVE AND LINEAR ACTUATOR

BACKGROUND

Many different types of drinking vessels have been developed over the course of human history. Such include cups, bowls, bottles, cans, glasses, mugs as well as other types of drinking vessels. In all cases, there is a chamber suited for containment of a liquid, or beverage, and an opening through which the person using the drinking vessels is able to extract a portion of the beverage. Extraction is commonly accomplished by changing the vessel's orientation or changing the pressure around the fluid.

However, the opening or mouth can also allow the beverage in the drinking vessel to spill. This can happen for any of many reasons. When a beverage does spill, what is spilt is usually lost, and may also cause damage to the items it comes in contact with. Some beverages can stain various items, cause resident inks or dyes to run due to a solvent-like action thus rendering the item damaged. Examples are car upholstery, car seat covers, home furniture, carpeting and many other things that can suffer damage or even deterioration due to the spillage and type of liquid that has been spilt.

In instances where the beverage is heated, there are additional risks associated with spilling thereof. When this type of drink is spilled, it has the potential to burn people or animals which have contact with the spilt liquid.

Other problems arise when a drinking container is invaded by insects such as bees, wasps, or other pests which are small enough to enter through the container discharge. Many people have received stings and bites from drink invaders when enjoying a beverage outdoors. The invader is attracted to the beverage and are often able to enter the container without the user knowing. Stings and bites are likely to cause pain to the user and can also present serious harm to people who have allergic reactions to such. The shock from such an attack can also cause choking and instills fear in using such drink containers outdoors, especially in the case of people who already fear such invaders.

Also, it is a well known problem, and has been for many years, that open beverages in motor vehicles commonly spill. Cars are now typically fitted with drink holders and the increasing popularity of drive-thru fast food increases the use of drinking containers in cars. Even prior to the inclusion of the cup holders as a standard feature in most vehicles, many people had aftermarket holders of various types and approaches to hold the containers at a convenient location and in a manner that was hoped to prevent spillage. Unfortunately many of these devices and the containers used with them don't prevent spillage, especially when the vehicle undergoes acceleration in various directions or deceleration.

When a spill occurs in a vehicle which is in motion, this typically distracts the vehicle operator. This is especially exemplified in the case of hot beverages burning the vehicle operator, but any spilling may equally affect concerned vehicle owners just the same. Such distractions may result in a collision with another vehicle or a pedestrian, either of which often result in the death of, or serious injury to, people involved.

Children and individuals with impaired motor skills may more often lose their grip on drinking vessels, and, even if the vessel is not dropped, the contents may be spilt. People who are multitasking while drinking, such as car operators often do, are also more likely to accidentally drop a drinking vessel. Also, such people do not benefit from overly complex and difficult to operate lid devices.

Although many attempts have been made to provide an easy to use, effective container and container top that prevents spillage, most or all suffer from continuing problems which proves this problem is not easily solved and thus advancements are sought after.

Some or all of the problems explained above and other problems may be helped or solved by the inventions shown and described herein. Such inventions may also be used to address other problems not set out above or which are only understood or appreciated at a later time. The future may also bring to light currently unknown or unrecognized benefits which may be appreciated or more fully appreciated in the future associated with the novel inventions shown and described herein.

BRIEF DESCRIPTION OF THE DRAWINGS

Preferred forms, configurations, embodiments and/or diagrams relating to and helping to describe preferred aspects and versions of the inventions are explained and characterized herein, often with reference to the accompanying drawings. The drawings and all features shown therein also serve as part of the disclosure of the inventions of the current document, whether described in text or merely by graphical disclosure alone. Such drawings are briefly described below.

DESCRIPTION

Figure 1:
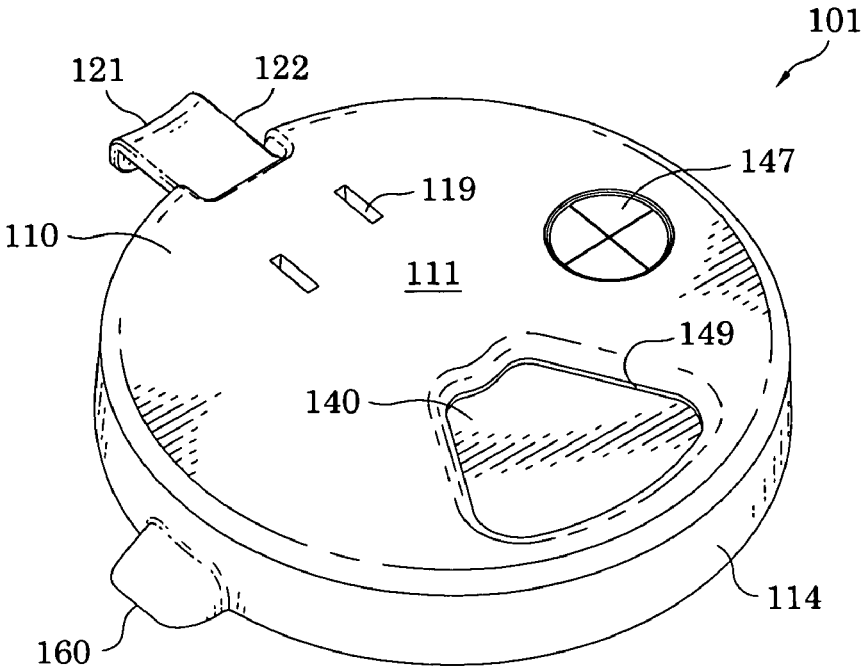
FIG. 1 depicts a perspective view of a first preferred embodiment of the apparatus according to the inventions hereof.

A table of subsections for the detailed description is set out below.

Table of Subsections

Introductory Notes
Apparatus
- FIGS. 1, 2, 3 and 4
- FIGS. 5 and 6
- FIGS. 7 and 8

Methods
Manner of Use and Utility of the Inventions
Preferred Manners of Making
Interpretation Notes

Introductory Notes

The readers of this document should understand that the embodiments described herein may rely on terminology used in any section of this document and other terms readily apparent from the drawings and the language common therefor as may be known in a particular art and such as known or indicated and provided by dictionaries. Dictionaries were used in the preparation of this document. Widely known and used in the preparation hereof are Webster's Third New International Dictionary (© 1993), The Oxford English Dictionary (Second Edition, ©1989), and The New Century Dictionary (©2001-2005), all of which are hereby incorporated by reference for interpretation of terms used herein and for application and use of words defined in such references to more adequately or aptly describe various features, aspects and concepts shown or otherwise described herein using more appropriate words having meanings applicable to such features, aspects and concepts.

This document is premised upon using one or more terms with one embodiment that may also apply to other embodiments for similar structures, functions, features and aspects of the inventions. Wording used in the claims is also descriptive of the inventions, and the text of both claims and abstract are incorporated by reference into the description entirely in the form as originally filed. Terminology used with one, some or all embodiments may be used for describing and defining the technology and exclusive rights associated herewith.

The readers of this document should further understand that the embodiments described herein may rely on terminology and features used in any section or embodiment shown in this document and other terms readily apparent from the drawings and language common or proper therefor. This document is premised upon using one or more terms or features shown in one embodiment that may also apply to or be combined with other embodiments for similar structures, functions, features and aspects of the inventions and provide additional embodiments of the inventions.

Each embodiment has been assigned unique 100 series reference numerals. Embodiments that share like features will use the same 10 series identifier with their unique 100 series embodiment identifier. For example, a feature may be identified as 112 for a first embodiment and 212 for a second embodiment. Such allows for easy recognition of like features and prevents redundancy in the description since like features will not be re-described for each embodiment unless otherwise needed.

Apparatus

FIGS. 1, 2, 3 and 4

To facilitate an understanding of the inventions, explanation of apparatus 101 and the inventions hereof will be structured in an order according to the referenced drawings and what they illustrate. Beginning with a more general understanding of the apparatus 101 and the inventions hereof, reference is given to FIGS. 1, 2, 3 and 4.

Looking at FIG. 1, a perspective view of apparatus 101 is depicted. The apparatus 101 may act as a lid for controlled drinking from a container, in accordance with the teachings of the present inventions. The apparatus may comprise at least one wall, or upper wall. FIG. 1 shows a wall, or central portion, 110 with surface 111. The apparatus may comprise at least one collar, or edge. FIG. 1 shows edge or rim 114 which extends about the periphery of the wall.

The apparatus may comprise at least one linear actuator. Such is shown as linear actuator 120, which acts to provide control over the egress of a container's contents. The apparatus may comprise at least one gate valve. Such is shown as gate valve 140, which acts to occlude egress. The apparatus may comprise at least one opening. Such is shown as opening 149 in the wall 110. Opening 149 provides egress from the apparatus and the attached container. The apparatus may comprise at least one outer portion, or button. Such is shown in FIG. 1 as outer portion 122, which is part of the linear actuator 120, and may extend beyond the apparatus's periphery through a passage in the collar 114. The apparatus may comprise at least one bent segment. Such is shown as bent segment 121. The bent segment 121 is part of outer portion 122 and, in the current embodiment, extends generally perpendicular to the linear actuator 120. Bent segment 121 advantageously provides a surface for applying pressure during operation of the linear actuator 120. When the apparatus is engaged with a drink container, a user may apply force to outer portion 122 via bent segment 121 with a digit of their hand or by some other convenient means. Such would cause the linear actuator 120 to open the gate valve 140 and allow egress of the beverage, or other foodstuffs present in the container, through opening, or mouth, 149.

The apparatus may include at least one removal feature. Such is shown as removal feature 160. Such may aid disengagement of the apparatus by providing a gripping surface for prying the apparatus from a drinking container.

The apparatus may comprise at least one straw feature. This optional feature is shown as straw feature 147 in wall 110. Such advantageously facilitates insertion of a straw, or similar device, through wall 110, where it can then access the drinking container's contents. Straw feature 147 comprises weakened portions of wall 110, which can be separated and thus provide an opening through wall 110 for passage of a straw therethrough. Additional means may also be used as a straw feature to allow entry of a straw through the apparatus.

Figure 2:
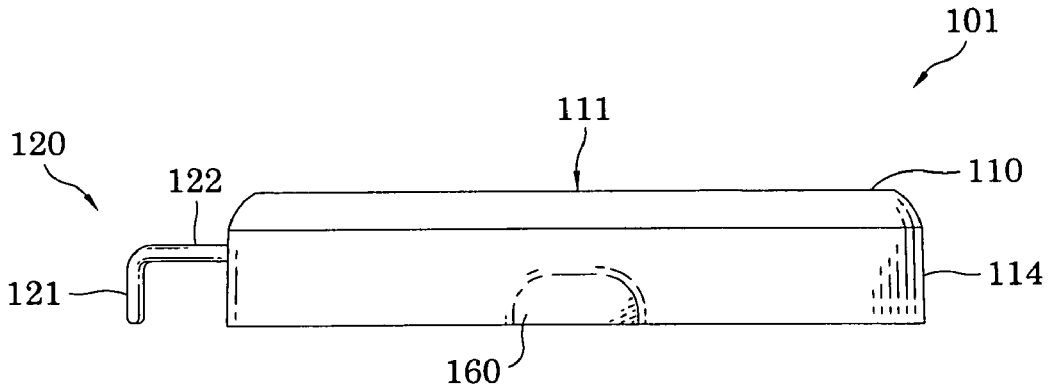
FIG. 2 depicts a left side view thereof; the right side being a mirror view thereof without the disengagement feature.

Looking at FIG. 2, a left side view of apparatus 101 is depicted. Such illustrates the added benefit of bent segment 121 on outer portion 122. Such provides an area for application of pressure thereto to ease operation of linear actuator 120. Although bent segment 121 is directed downward, it may also be directed upward, both upward and downward, or in some other fashion which advantageously provides a means for applying pressure to linear actuator 120.

Linear actuator 120 extends through, and slidably moves within, a passage in collar 114. Such passage has a similar cross sectional shape to that of linear actuator 120 and is sufficiently small so that it may prevent escape of container contents therethrough. Additional means may also be used to prevent egress of contents therethrough.

Figure 3:
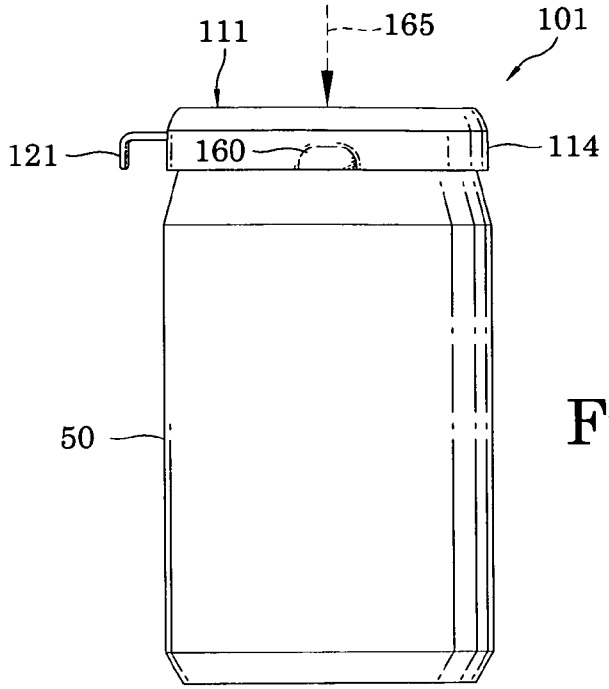
FIG. 3 depicts a side view of the apparatus engaged with a common drinking container.

Looking at FIG. 3, a left side view is shown of apparatus 101 engaged, or coupled, with a common drinking vessel 50, taking a shape similar to most soda cans. Such illustrates the potential use of the apparatus with this type of common container. The apparatus 101 may engage a drinking vessel, such as illustrated with vessel 50, by application of force along direction arrow 165 to the apparatus, more likely to wall surface 111 and possibly collar 114. The apparatus engages with a container via at least one engagement feature. Such is shown with the current embodiment as at least one rib or thread 116, illustrated in FIGS. 5, 7 and 8, binding on an uneven surface, rib or thread on the drinking container. An upper rib is common to many drinking vessels. However, additional methods of engagement may also be used, when a rib is not present. More will be described later on engagement of the device to a container.

In the situation of FIG. 3, where a can is used, such and other similar containers usually have limited openings or mouths in the top surface of the container which allow egress of the contained drink. When using a container with a limited opening, the user may benefit from positioning the container's opening with respect to the opening 149. Such may be accomplished by aligning the two openings such that the container's opening is directly underneath or face to face with opening 149.

Figure 4:
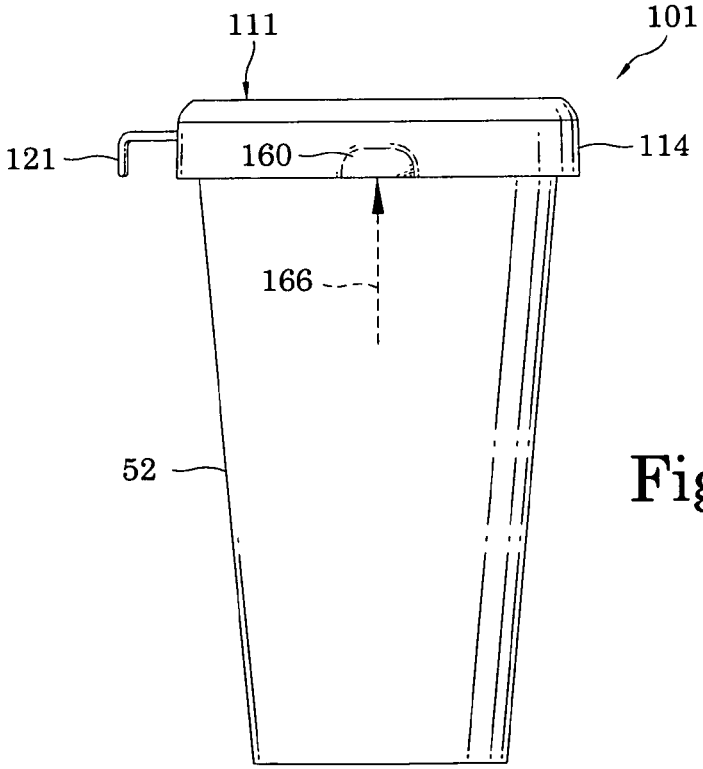
FIG. 4 depicts a side view of the apparatus engaged with another type of common drinking container.

Looking at FIG. 4, a left side view is shown of apparatus 101 engaged, or coupled, with another common drinking vessel 52, such vessel or container taking a shape similar to many cups and glasses. Such illustrates the potential use of the apparatus with another type of common container. The apparatus may disengage a drinking vessel, such as illustrated with vessel 52, by application of force along direction arrow 166 to the apparatus, more likely to removal feature 160. Various other containers may be used as well, even though use therewith is not explicitly shown or described herein. Such containers include containers with substantially planer tops that do not have protrusions that would contact the wall 110 and the moving components attached thereto. Contact with such parts may prevent apparatus 101 from engaging with the container and/or hinder operation thereof.

It may be advantageous to relocate the components attached to surface 112 (FIGS. 5-8) to surface 111 of wall 110. Such would benefit use with containers that have protrusions which may contact the apparatus's moving parts and prevent motion thereof. At least one guard plate may also be present to cover the moving parts and prevent introduction of objects into the space necessary for movement of these parts.

Figure 5:
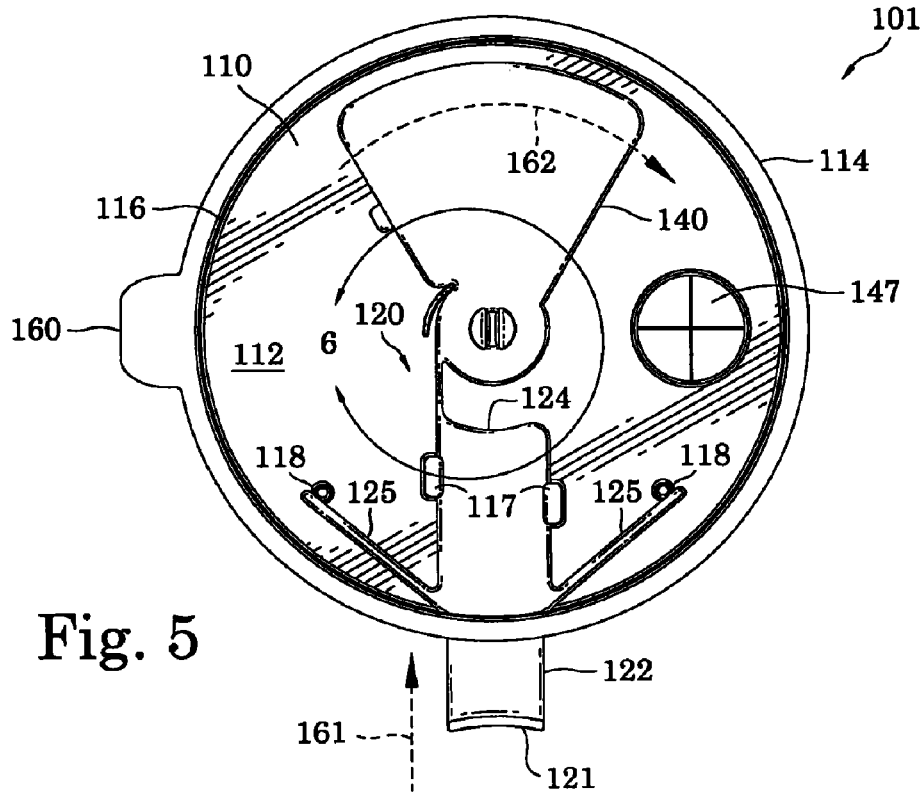
FIG. 5 depicts a bottom view of the apparatus of FIG. 1.
Figure 6:
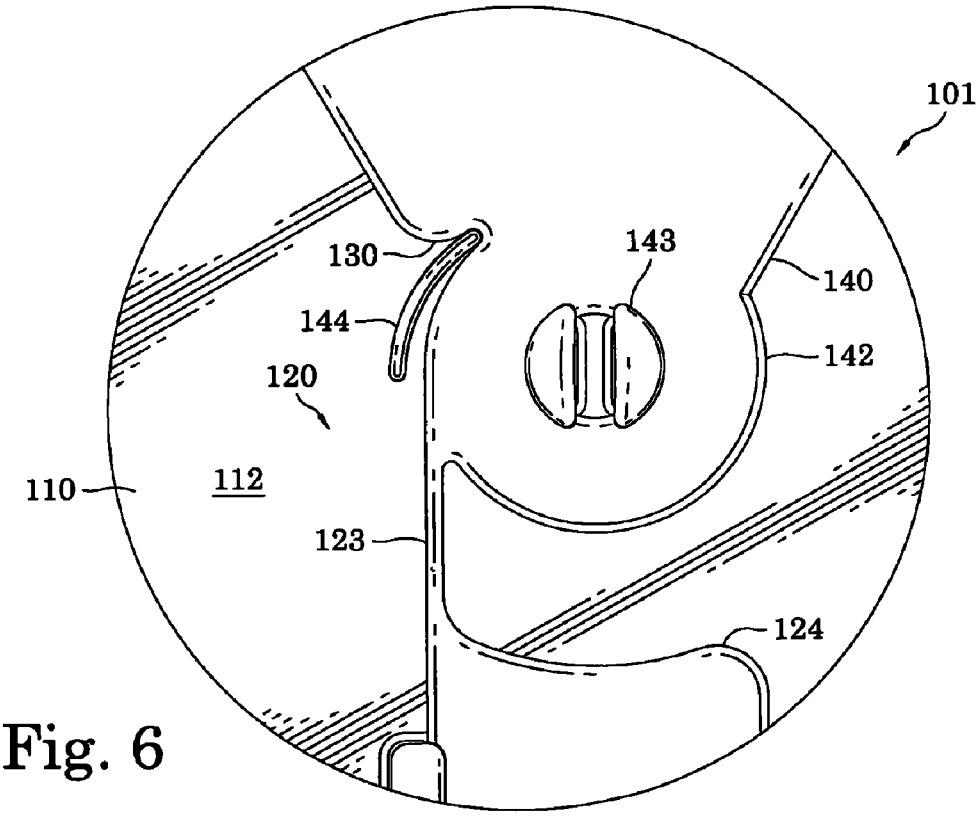
FIG. 6 depicts a close-up view thereof of the portion indicated by circle line 6 of FIG. 5.

FIGS. 5 and 6

Looking at FIGS. 5 and 6, a bottom view of apparatus 101, in a closed state, is shown. A closed state is defined as when the gate valve 140 essentially fully occludes opening 149 and thus may be capable of preventing unwanted spillage from the container.

FIGS. 5 and 6 illustrate the internal workings of apparatus 101. Such show linear actuator 120 and its inner, or second, portion 124. Inner portion 124 extends within the collar 114 periphery, continuing from the outer portion 122. The apparatus may comprise at least one narrowed portion, or web. Such is shown as distal narrowed portion 123 in FIG. 6. The narrowed portion 123 is attached to the gate valve 140 via tang portion 142, with such attachment allowing for sufficient rotation of the gate valve 140 from a closed to an open position. The entirety of the linear actuator 120, and all parts attached thereto, are shown as being formed from one unitary body. However, it may also be advantageous to form such from several bodies which would be sufficiently attached to one another. Different bodies may also allow for use of differing materials for each part if such is found to be desirable.

The apparatus may include at least one clip. In FIG. 5, clips 117 are shown. Such extend from wall 110, surface 112, along the sides of inner portion 124 of linear actuator 120, then pass across the inner portion's outer surface. The clips 117 act to limit the translational movement of linear actuator 120 to directions along arrow 161. It may prove advantageous to have at least one clip that spans part of, or the entire width of, linear actuator 120. Looking back to FIG. 1, recessions 119 can be seen in opposite surface 111. Such are where the clips 117 are formed out of wall 110. Clips 117 may be formed by molding them into wall 110, as is shown, or through other configurations and methods to produce clips 117.

The apparatus may comprise at least one biasing mechanism. As shown in FIG. 5, biasing mechanisms, or springs, 125 are attached on both sides of the inner portion 124. Such act to bias the linear actuator 120, and thus gate valve 140, toward a closed position, as demonstrated in FIGS. 1, 2, 5 and 6, thus maintaining a default, closed position during non-use of the linear actuator. In the closed position, gate valve 140 occludes opening 149, therefore helping prevent the unwanted escape of the beverage container's contents when the linear actuator 120 is not being depressed. Springs 125 may be formed out of a unitary body with the linear actuator 120, as shown, or they may also be a separate piece, possibly of a differing material, attached thereto. In the case of more than one spring, it may prove beneficial to have at least one spring in a differing shape and or configuration from the rest. Such additional spring configurations may include a curved spring, a hair pin spring, or other spring. The at least one biasing mechanism can therefore be a spring disposed between the linear actuator 120 and a center portion, and biased to urge the outer portion 122 away from the collar 114. For example, the biasing mechanism can be a coil spring attached at a first end to the edge or collar 114, and attached at a second end to the linear actuator 120 at a location distal from the collar 114. In another example, the biasing mechanism can be a leaf-spring arrangement similar to springs 125 depicted in FIG. 5, but with the fixed ends of the springs being secured to the surface 112, and the free ends in contact with protrusions or the like on the linear actuator 120. In yet another variation the biasing member can be a coil spring or folding spring attached at a first end to the tang 142 at a location proximate the edge of the tang, and at a second end at location on the surface 112 distal from the tang.

The apparatus 101 may comprise at least one pivot. A pivot, or pivot pin, 143, which is shown attached to the wall 110, secures gate valve 140 thereto via tang portion 142. The pivot 143 prevents translation of gate valve 140 while allowing rotation thereof. As shown in FIGS. 5 and 6, gate valve 140 includes tang portion 142, which extends radially outward away from the main body of the gate valve 140, into the path of the narrowed portion 123. The narrowed portion 123 attaches to the tang portion 142 to one side of the pivot 143. During sliding motion of the linear actuator 120, such creates a rotational moment about the pivot 143, which causes the gate valve 140 and tang portion 142 to slidably rotate about the pivot 143. As depicted in FIGS. 5 and 6, the linear actuator 120, including narrowed portion 123, and the gate valve 140, including tang 142, can all be formed as a single unitary component.

The apparatus may comprise at least one guide. Guide 144 is shown secured to wall 110 surface 112. The size and shape of the guide 144 may vary. It may be beneficial to have a guide which extends along the entire length of narrowed portion 123. The narrowed portion 123 is sufficient to bend and does so during sliding motion of the linear actuator 120. Guide 144 acts to control narrowed portion 123, during bending thereof. During inward motion of the linear actuator 120, narrowed portion 123 may have the tendency to bend outward and only partially apply rotational force to gate valve 140. Guide 144 may help to prevent such. This may help to maintain a more constant rotation of gate valve 140 during motion of the linear actuator 120 as well. Guide 144 can be formed as an integral part of wall 110 in a manner similar to clips 117, or guide 144 can be a separate component secured to wall 110. Guide 144 also can act as a stop to prevent over-rotation of the gate valve 140 when moved to the closed position, as depicted in FIG. 6.

The apparatus may comprise at least one receptacle. Receptacle 130 is shown on gate valve 140 near tang portion 142. Such acts to prevent over-rotation of the gate valve 140. When the gate valve 140 is in a closed position, guide 144 is received within, and contacts, receptacle 130. Such contact may prevent further rotation of the gate valve 140 once the closed position is reached. Further rotation of the gate valve 140 in a counter-clockwise direction (from the position depicted in FIG. 5) may put the gate valve into a position which does not fully occlude opening 149, which may allow unwanted spillage. Over-rotation of the gate valve 140 may also prevent the linear actuator 120 from operating properly to open the gate valve.

In FIG. 5, the opening rotational path is indicated by arcuate direction arrow 162. This occurs responsive to pressure being applied to the outer portion 122 of the linear actuator 120, causing motion thereof, along direction arrow 161. As a result, the spring 125 is driven into or further into compression and thus creates forces for restoring the linear actuator 120 and gate valve 140 to the closed position, when the user no longer applies the pressure to outer portion 122.

Figure 7:
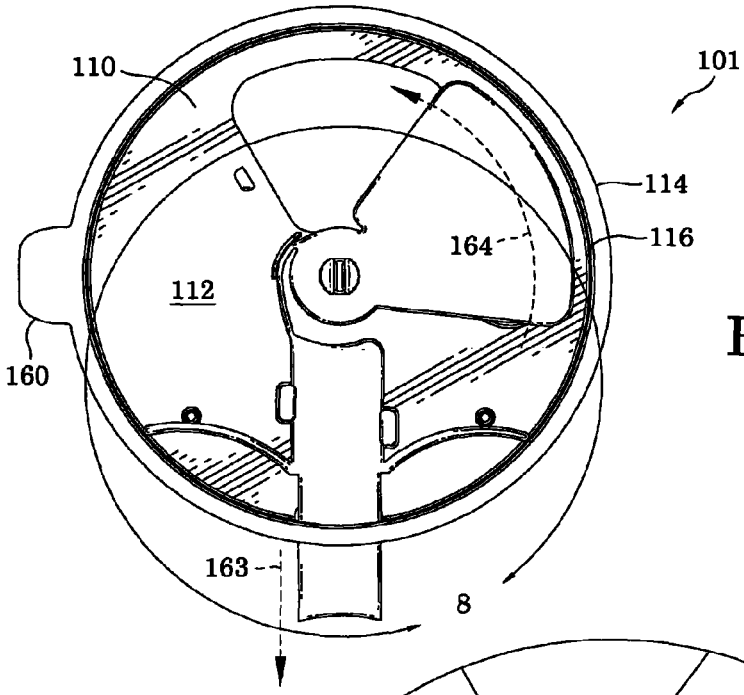
FIG. 7 depicts a bottom view of the apparatus of FIG. 1 in an open position.

It will be appreciated from the discussion above that the outer portion 122 of the linear actuator 120 protrudes outward from the collar 114 periphery when the gate valve 140 is in the closed position as depicted in FIG. 5, but extends at least partially inward of the collar 114 periphery when the gate valve 140 is in the open position as depicted in FIG. 7. Thus the term outer portion for part 122 is not intended as limiting the location of the entire part at all times to a location outward from the collar 114 periphery.

Figure 8:
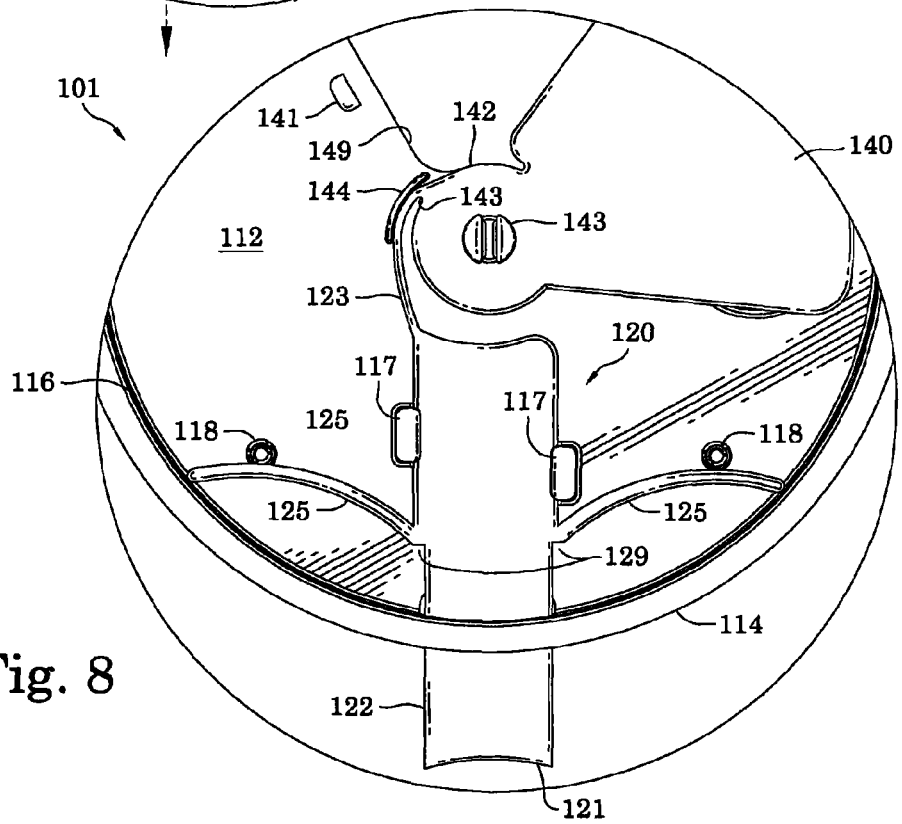
FIG. 8 depicts a close-up bottom view thereof of the portion indicated by circle line 8 of FIG. 7.

The apparatus may comprise at least one gate stopper. In FIG. 8, a gate stopper, or stop, 141 is shown. Such may prevent over-rotation of the gate valve 140. When the gate valve 140 has returned to a closed position, it will contact gate stopper 141. Such contact may prevent further rotation which may put the gate valve 140 into a position which may not fully occlude opening 149.

One form of an engagement feature 116 (FIGS. 5, 7 and 8) previously discussed was the use of at least one rib. Such typically is employed with at least one corresponding rib (not shown) on the container 50 (FIG. 3) or 52 (FIG. 4) to provide positive engagement therebetween. With the use of plastic, and many other materials, to form collar 114, such materials give and bend. When the apparatus is forced down on a container, the rib on the container and the rib 116 on the apparatus will be essentially similar in size and will come in contact. When enough force is applied, the collar will give and deform slightly to allow passage of the apparatus's rib 116 around the container's rib, or vise-versa if the container's material is more flexible than the apparatus's. A similar amount of force in the opposite direction is then necessary to reverse the process to disengage the two.

It proves advantageous to have a multitude of different engagement configurations for securing a container to the apparatus for use. Such would allow the apparatus use with a broader assortment of containers. One such an engagement may be achieved with at least one thread on the upper outer periphery of the container. In such a case, the apparatus would need at least one thread 116 which effectively engages with the container's periphery thread through an axial twisting action.

Another option is to have a container with at least one sufficiently large lip around the upper periphery. At least one matching lip could be placed around the outer periphery of collar 114 and a clasping band, with at least one sufficiently large channel, shaped for receiving the lip, could be secured there around, engaging the apparatus to the container.

Yet another option is to use at least one screw which would pass through a threaded, or non-threaded, hole in the collar 114. Such would be directed from the outside of the collar inward toward the container. To engage the container, the screws could be tightened until a sufficient frictional force is created to prevent disengagement of the apparatus. This engagement option may also prove advantageous with the presence of an uneven surface on the container. Such may reduce the needed friction if the at least one screw is tightened such that it cannot pass over, or from, the uneven surface. Additional methods and means for securing the apparatus 101 to a container, not shown or described herein, may also prove advantageous in securing the apparatus to a container. In certain embodiments no specific feature is required on the container for engagement of the apparatus therewith. For example, when rib 116 is replaced by, or supplemented with, a compressible sealing member, such as a rubber o-ring, then friction between the compressible sealing member and the container can be sufficient to maintain the apparatus in position on the container. In yet another variation the apparatus 101 can be engaged with a container using clips or the like located at the periphery of the upper portion 110, and configured to engage a feature at the upper portion of the container. In this latter example the apparatus 101 can exclude the collar 114.

FIGS. 7 and 8

Looking at FIGS. 7 and 8, a bottom view of apparatus 101 is depicted, with the gate valve 140 in an open state. An open state can also include any position of the gate valve 140 between closed (as depicted in FIG. 5) and fully open (as essentially depicted in FIG. 7), where only a portion of the opening 149 is occluded by gate valve 140. In any of these open states, it is possible for at least a portion of the container's contents to pass through opening 149.

The apparatus may comprise at least one projection. As the linear actuator 120 is pressed inward, springs 125 bend against projections 118 creating the biasing forces which will return the linear actuator to it's default closed position with the gate valve 140 closed, as depicted in FIG. 5. Arcuate direction arrow 164 in FIG. 7 indicates the motion of the gate valve 140 in response to the movement of the linear actuator 120 along direction arrow 163. Such occurs when the pressure to the outer portion 122 is removed and the springs 125 are allowed to return to their normal state shown in FIGS. 5 and 6.

The narrowed portion 123 may also aid in applying restorative forces to return linear actuator 120 and gate valve 140 to a closed position from an open position. Additional narrowed portions 123 may be added to provide more restorative forces. Such may reduce the necessity of force by biasing mechanisms 125 and therefore allow for reduction thereof in size and/or quantity.

As the linear actuator 120 is forced inward, narrowed portion 123 drives the rotation of tang portion 142 and gate valve 140. As this happens, narrowed portion 123 winds around the circumference of tang 142. This is aided by guide 144. Such helps maintain the narrowed portion in a generally compressed state, prior to contact therewith, by limiting outward bending.

The apparatus may comprise at least one linear actuator stopper. In FIGS. 7 and 8, linear actuator stoppers 129 are shown. Such contact the inside of collar 114 at the closed state (i.e., when the gate valve 140 is in the closed position, as depicted in FIG. 5), thus preventing further outward movement of the linear actuator 120. This is advantageous in that it prevents over-rotation of the gate valve 140 during the transition from an open to a closed state. Over-rotation of the gate valve 140 may position it such that it does not fully occlude opening 149, even though it is intended to be in a closed position. Such over-rotation may therefore lead to spilling of the container's contents.

In one variation, the apparatus 101 includes a sealing member disposed between the inner surface 112 of wall 110 and the outward-facing surface of the gate valve 140. Such can facilitate in further reducing leakage of fluids or contents from the container through the opening 149 when the gate valve 140 is in the closed position. The sealing member can be a raised surface area, or an applied sealant, disposed around either the periphery of opening 149 near surface 112, and/or around the periphery of the gate valve 140 on a side thereof facing the surface 112. The sealing member can also be a tongue-and-groove configuration formed of complimentary features disposed around the opening 149 and the gate valve. In this latter example the tongue and groove can each be tapered at the edges to facilitate separation thereof when a force is applied to the gate valve 140 by the linear actuator 120 in direction 161 (FIG. 5).

Methods

After choosing a suitable container with means for engagement or coupling to the apparatus, the container is then filled with the desired beverage, fluid or possibly other foodstuff.

To engage the container with the apparatus, a method suitable to the chosen container and apparatus, and their engagement features, is used to engage the apparatus and the container. Such may be by placing the apparatus onto the container mouth, then applying downward pressure to the wall 110 and collar 114, along the central axis of the container. Such would be the method if a rib 116 is present on the apparatus and the container has a rib or uneven surface such that it allows similar engagement therewith as engagement means.

Another possible method of engagement would by placing the apparatus onto the container mouth, then screwing the lid onto the container. Such would be the method if suitable threads are present on the apparatus and the container as engagement means.

Another possible method of engagement would be by placing the apparatus onto the container mouth, then adjusting the at least one screw, present around the periphery of the collar 114, until the friction force created thereby is sufficient to retain the apparatus. Such would be the method if such screws are present on the apparatus. Additionally, other methods suitable to other engagement features may be used.

Once the apparatus is engaged with the container, a user may take a drink therefrom. Such would be accomplished by first opening the gate valve 140. By depressing the outer portion 122 the linear actuator 120 and narrowed portion 123 will create a moment about pivot 143, causing the gate valve 140 to rotate into an open position. Further depressing linear actuator 120 may expose more of opening 149. Additionally, releasing pressure from the outer portion 122 of linear actuator 120 will cause the at least one spring 125 to drive linear actuator 120 outward from the collar 114, rotating the gate valve 140 into a position which occludes more of opening 149.

After an open position is chosen, the user can take a drink, as they would normally from the container, by placing their lips adjacent opening 149 along collar 114, then tipping the container to dispense the fluids therein. Controlling the dispensing rate is accomplished by either changing the container's angle to gravity, or by changing the position of gate valve 140 relative to opening 149, thus changing the area of opening 149 occluded thereby.

After the user is finished drinking, fully releasing the linear actuator 120 will cause springs 125 to drive the linear actuator outward from the collar 114 and thus cause rotation of gate valve 140 into a closed position, fully occluding opening 149 and helping prevent unwanted spilling therefrom.

Manner of Use and Utility of the Inventions

A container, which can sufficiently engage with the apparatus, is first selected and filled with the desired contents, most likely fluids. The apparatus is then engaged to the container through a method described above, which may be by pressing or screwing the two together or by other means. Once engaged, the user can apply force to the outer portion of linear actuator 120. Such causes the rotation of gate valve 140 from the closed position to an open position. The container can then be tipped to bring the fluid, or other, contents to the opening 149. The user can then drink from the apparatus with their lips adjacent opening 149 against collar 114. Further tipping and/or depression of the linear actuator 120 will increase the content's rate of flow from the mouth 149. Doing the opposite will impede the rate of flow therefrom. After the user is finished, fully releasing the linear actuator 120 will cause the gate valve 140 to close, helping to prevent unwanted spillage from opening 149.

The inventions hereof may be useful for controlling the dispensing of fluid contents from a drinking container. Such may also be useful with dispensing other foodstuffs as well.

Preferred Manners of Making

Various portions and components of apparatus within the scope of the inventions, including for example, structural components, can be formed by one or more various suitable manufacturing processes known to those in the art of container lids. Similarly, various portions and components of apparatus within the scope of the inventions can be made from suitable materials known to those in the art of container lids.

Interpretation Notes

The above description has set out various features, functions, methods and other aspects of the inventions. This has been done with regard to the currently preferred embodiments thereof. Time and further development may change the manner in which the various aspects are implemented. Such aspects may further be added to by the language of the claims which are incorporated by reference hereinto as originally filed.

The scope of protection accorded the inventions as defined by the claims is not intended to be necessarily limited to the specific sizes, shapes, features or other aspects of the currently preferred embodiments shown and described. The claimed inventions may be implemented or embodied in other forms while still being within the concepts shown, described and claimed herein. Also included are equivalents of the inventions which can be made without departing from the scope of concepts properly protected hereby.

I claim:

1. An apparatus to reduce probability of spillage of a beverage from a drinking container, comprising:

a lid having an aperture adjacent a periphery;

a closure device comprising a single continuous piece of material, the closure device having an actuator portion, a web portion and a valve portion, the actuator portion having a distal portion extending outward of the periphery, a proximal portion of the actuator portion being attached to a first end of the web portion, a second end of the web being attached to the valve portion, the valve portion configured to rotate about a pivot point and move from a closed position essentially occluding the aperture when the actuator portion is in a first position, towards an open position away from the aperture and winding the web around a suitably shaped region partially surrounding the pivot point when the actuator portion is moved towards a second position.

2. Apparatus according to claim 1 further comprising a biasing mechanism for biasing the actuator portion towards the first position, and thus the valve portion towards the closed position, when the actuator portion is not being depressed.

3. Apparatus according to claim 1 further comprising a mechanism for biasing the actuator portion towards the first position, and thus the valve portion towards the closed position, when the actuator portion is not being depressed, the biasing mechanism comprising a spring having a first end coupled to the actuator portion.

4. Apparatus according to claim 1 further comprising a mechanism for biasing the actuator portion towards the first position, and thus the valve portion towards the closed position, when the actuator portion is not being depressed, the biasing mechanism comprising a spring having a first end coupled to the lid.

5. Apparatus according to claim 1 wherein the valve portion forms a gate valve and a tang, the tang forming the suitably shaped region partially surrounding the pivot point, the gate valve obscuring the aperture in the closed position.

6. Apparatus according to claim 1, wherein the closure device is attached to the lid by a pivot pin extending through the pivot point near a center of the lid.

7. Apparatus according to claim 1, further comprising a collar formed along the periphery, the collar having a lower peripheral portion including an inwardly extending lip to affirmatively engage a mouth of the drinking container.

8. An apparatus forming a cap for a beverage container having a mouth through which liquid contents are drank, the cap including in combination:

a wall having a circular shape and defining a periphery;

an opening extending through the wall near the periphery;

an engagement portion for affirmatively engaging the cap with the mouth of the beverage container, such that the cap covers the mouth;

an actuator linearly slidably engaged with the wall, a first portion of the actuator extending past the periphery and a second portion of the actuator extending inward of the periphery;

a gate valve having a major planar portion and a pivot point, the gate valve configured to pivot along the periphery about the pivot point to cause the major planar portion to uncover the opening, responsive to depression of the actuator towards the periphery;

a web mechanically coupling the second portion to the gate valve near the pivot point, the actuator, gate valve and web comprising a single piece of material, the web winding about a suitably shaped portion of the gate valve partially surrounding the pivot point, responsive to depression of the actuator towards the periphery.

9. An apparatus according to claim 8, wherein the engagement portion includes a collar formed along the periphery, the collar having a lower peripheral portion including an inwardly extending lip to affirmatively engage a mouth of the drinking container.

10. An apparatus according to claim 8, wherein the engagement portion includes a collar that snaps onto or off of the mouth of the beverage container.

11. An apparatus according to claim 8, wherein the engagement portion includes a collar that screws onto or off of the mouth of the beverage container.

12. An apparatus according to claim 8, further comprising a spring biasing the actuator outward of a center of the wall and causing the gate valve to close, and also causing the web to unwind from the suitably shaped portion, when the actuator is released.

13. An apparatus according to claim 8, further comprising a spring which becomes less compressed when the actuator is released.

14. An apparatus according to claim 8, wherein the web unwinds from the suitably shaped portion responsive to mechanical bias when the actuator portion is released.

15. A process for uncovering an opening in a lid for a beverage container, the process comprising acts of:

depressing a first end of an actuator towards a periphery of the lid;

winding a web attached to a second end of the actuator about a curved portion of a gate valve responsive to said depressing; and pivoting the gate valve about a pivot point proximate the curved portion to cause the gate valve to move from a first position covering an opening near a periphery of the lid towards a second position not covering the opening, the actuator, the web and the gate valve being formed from a single piece of material.

16. A process according to claim 15, wherein the gate valve is spring biased towards the first position, and further comprising acts of:

releasing the first end of the actuator;

unwinding the web; and pivoting the gate valve about the pivot point to the first position.

17. A process according to claim 15, further comprising, prior to depressing the actuator, winding the web, or pivoting the gate valve, an act of affirmatively attaching the lid to a mouth of the beverage container.

18. A process according to claim 15, further comprising, prior to depressing the actuator, winding the web, or pivoting the gate valve, an act of snapping the lid over a mouth of the beverage container.

19. A process according to claim 15, further comprising an act of detaching the lid from a mouth of the beverage container.

20. A process according to claim 15, further comprising an act of unsnapping the lid from a mouth of the beverage container.

* * * * *